US010871349B2

(12) United States Patent
Kowalczyk et al.

(10) Patent No.: US 10,871,349 B2
(45) Date of Patent: Dec. 22, 2020

(54) FIREARM ASSOCIATED ELECTRONIC DEVICE WITH ACCELERATION RESISTANT LATCH

(71) Applicant: Crosman Corporation, Bloomfield, NY (US)

(72) Inventors: John A. Kowalczyk, Fairport, NY (US); Jeffrey W. Mock, Rochester, NY (US); Jeffrey D. Hanson, West Henrietta, NY (US)

(73) Assignee: CROSMAN CORPORATION, Bloomfield, NY (US)

( * ) Notice: Subject to any disclaimer, the term of this patent is extended or adjusted under 35 U.S.C. 154(b) by 656 days.

(21) Appl. No.: 14/988,400

(22) Filed: Jan. 5, 2016

(65) Prior Publication Data

US 2016/0195366 A1 Jul. 7, 2016

Related U.S. Application Data

(60) Provisional application No. 62/099,879, filed on Jan. 5, 2015.

(51) Int. Cl.
*F41G 11/00* (2006.01)
*F41A 35/00* (2006.01)
(Continued)

(52) U.S. Cl.
CPC ..... *F41G 11/00* (2013.01); *F41A 11/00* (2013.01); *F41A 35/00* (2013.01); *F41C 27/00* (2013.01);
(Continued)

(58) Field of Classification Search
CPC .. F41G 11/00; F41G 1/34; F41A 11/00; F41A 35/00; F41C 27/00;
(Continued)

(56) References Cited

U.S. PATENT DOCUMENTS 4,050,272 A * 9/1977 Tanaka ..... E05B 65/0811 70/100
4,434,635 A * 3/1984 Borgato ..... E05B 47/0002 292/108
(Continued)

OTHER PUBLICATIONS

LaserMax,Inc., "UNI(TM) Rail Mounted Lasers Operator's Manual", available at <<https://www.lasermax.com/pub/media/Im_files/1461196800_unimanual_pdf>>, 14 pages.

*Primary Examiner* — Kristina R Fulton
*Assistant Examiner* — Faria F Ahmad
(74) *Attorney, Agent, or Firm* — Lee & Hayes, P.C.

(57) ABSTRACT

Firearm associated electronic devices are provided. In one aspect a firearm associated device has a housing having a holding area and an opening through which a removable component may be positioned in the holding area, a door movable relative to the housing and having a door latch that moves along a path as the door moves and a housing latch movable between a first latch position where the housing latch is not in the path to a second latch position where the housing latch blocks movement of the door latch from a first range of positions where the door prevents the removable component from passing through the opening to a second range of positions where the door does not prevent the removable component from passing through the opening. A housing latch biasing member biases the housing latch into the second latch position. When the door latch is in the first range of positions and the housing latch is in the second latch position the door latch is movable along the path but is blocked by the housing latch from passing to the second range of positions.

20 Claims, 11 Drawing Sheets

(51) Int. Cl.

| | |
|---|---|
| ***F41G 1/34*** | (2006.01) |
| ***F41C 27/00*** | (2006.01) |
| ***F41A 11/00*** | (2006.01) |
| ***F41G 1/35*** | (2006.01) |

(52) U.S. Cl.
CPC ..... *F41G 1/34* (2013.01); *F41G 1/35* (2013.01); *Y10T 292/0825* (2015.04); *Y10T 292/0862* (2015.04); *Y10T 292/0863* (2015.04); *Y10T 292/0911* (2015.04); *Y10T 292/0913* (2015.04); *Y10T 292/1043* (2015.04); *Y10T 292/1049* (2015.04)

(58) Field of Classification Search
CPC ..... Y10T 292/1043; Y10T 292/0825; Y10T 292/0862; Y10T 292/0863; Y10T 292/0911; Y10T 292/1049; Y10R 292/0913
USPC ..... 292/194, 24, 56, 57, 95, 109, 114, 218
See application file for complete search history.

(56) References Cited

U.S. PATENT DOCUMENTS 4,915,428 A * 4/1990 Hayakawa ..... E05B 65/0811 292/29
5,413,499 A * 5/1995 Wright, Jr. ..... H01M 2/1066 429/1
5,498,039 A * 3/1996 Bivens ..... B60N 3/08 292/145
5,508,124 A * 4/1996 Gordecki ..... H01M 2/1055 429/100
5,595,409 A * 1/1997 Fier ..... E05B 17/042 292/112
5,752,595 A * 5/1998 Fein ..... H01H 23/025 200/302.3
5,820,406 A * 10/1998 Hetherington ..... G08B 29/181 439/500
6,079,756 A * 6/2000 Phillips ..... E05B 47/0002 292/198
6,117,575 A * 9/2000 Dinsdale ..... H01M 2/1055 429/1
6,616,199 B1 * 9/2003 Tokach ..... E02F 9/0866 292/11
7,029,040 B2 * 4/2006 Lippoldt ..... B04B 7/06 292/122
7,178,839 B2 * 2/2007 Tsai ..... E05B 65/0858 292/112
7,255,375 B2 * 8/2007 Heid ..... E05B 15/0006 292/112
7,427,086 B2 * 9/2008 Park ..... D06F 39/14 292/121
7,492,273 B2 * 2/2009 Sharpe ..... G08B 29/181 340/628
7,583,500 B2 * 9/2009 Ligtenberg ..... G06F 1/1616 361/147
8,109,541 B2 * 2/2012 Chang ..... E05C 9/045 292/95
8,376,478 B2 * 2/2013 Weber ..... E05B 17/0054 312/209
8,408,607 B2 * 4/2013 Michael ..... B65F 1/1615 292/95
8,899,636 B2 * 12/2014 Fitzgerald ..... E05B 15/0053 292/251.5
9,897,407 B2 * 2/2018 Kramer ..... F41J 5/10
9,963,913 B2 * 5/2018 Howell ..... E05B 47/0038
9,979,871 B2 * 5/2018 Kennair, Jr. ..... H04N 7/181
2004/0229113 A1 * 11/2004 Sharpe ..... H01M 2/1066 429/98
2004/0242042 A1 * 12/2004 Buck ..... B25F 5/02 439/160
2005/0073283 A1 * 4/2005 Friedli ..... H01R 13/6275 320/114
2005/0121918 A1 * 6/2005 Smock ..... F24C 15/022 292/109
2006/0119108 A1 * 6/2006 Heid ..... E05B 15/0006 292/97
2007/0138806 A1 * 6/2007 Ligtenberg ..... H05K 5/0221 292/251.5
2008/0112698 A1 * 5/2008 Ray ..... G03B 29/00 396/56
2008/0142522 A1 * 6/2008 Maid ..... E05C 3/167 220/324
2009/0255084 A1 * 10/2009 Gee, II ..... H01M 2/1022 15/412
2010/0053857 A1 * 3/2010 Zhu ..... E05B 63/248 361/679.01
2012/0312594 A1 * 12/2012 Hapke ..... H01H 36/00 174/668
2013/0235562 A1 * 9/2013 Chauvie ..... F41G 1/35 362/110
2014/0322673 A1 * 10/2014 Uhr ..... F41A 35/00 434/21
2015/0241169 A1 * 8/2015 Cheng ..... F41G 1/34 42/114
2015/0369554 A1 * 12/2015 Kramer ..... H04N 9/8205 386/227
2016/0201363 A1 * 7/2016 Akahori ..... E05B 85/02 292/194
2016/0209169 A1 * 7/2016 Toole ..... F41C 23/22
2016/0327371 A1 * 11/2016 Teetzel ..... F41C 23/16
2017/0176140 A1 * 6/2017 Harrison ..... G02B 27/34
2018/0023910 A1 * 1/2018 Kramer ..... H04N 5/907 386/227
2018/0364009 A1 * 12/2018 Hancosky ..... F41G 1/35
2020/0158473 A1 * 5/2020 Wells ..... F41G 11/003
2020/0300580 A1 * 9/2020 Kowalczyk, Jr. ..... F41G 1/35

* cited by examiner

FIREARM ASSOCIATED ELECTRONIC DEVICE WITH ACCELERATION RESISTANT LATCH

CROSS-REFERENCE TO RELATED APPLICATIONS

This application claims the benefit of U.S. Provisional Application No. 62/099,879 filed Jan. 5, 2015.

FIELD OF THE INVENTION

The present invention relates to the field of firearm associated electronic devices and more particularly to firearm associated electronic devices that are associated with firearms and that have removable components that must be securely held during firearm use and discharge but conveniently released when desired.

BACKGROUND

Associating firearm associated electronic devices with firearms has always been a challenging task in that the firearm associated electronic devices must be capable of surviving extreme levels of rapid acceleration during firearm discharge as well as rough handling between uses. Replaceable elements such as batteries and memory cards present a particular challenge for use with such devices as they require replacement or substitution. This requires that the replaceable elements be mounted in a fashion that secures the replaceable elements to the firearm associated electronic device in a way that is not disrupted even temporarily by the extreme accelerations experienced during firearm discharge.

Additionally, there is a need to protect against inadvertent release of the replaceable component such as by incidental contact between latching mechanisms of the firearm associated electronic devices and adjacent objects such as holsters during transport of the firearm.

Accordingly, fasteners are often used to secure replaceable components under such circumstances. For example, the LaserMax LMS-UNI-MAX RED sold by LaserMax, Inc. uses a pair of screws to secure a battery door to the laser housing. However, given that consumers typically prefer firearm associated electronic devices that are as small as possible, it is typically necessary that such fasteners be small. Such small fasteners are easily lost and can be difficult to manipulate except under controlled circumstances. Often removal and replacement of such fasteners requires the use of a tool that may not available when needed. Accordingly, it can be a complex and inordinately time-consuming task to replace such components.

What is needed in the art is a firearm associated electronic device for use with a firearm that can effectively hold a replaceable component against both the extreme accelerations experienced during firearm discharge and also against inadvertent release the replaceable component, while also providing a quick, intuitive, tool and fastener free way to remove and install the replaceable component.

SUMMARY OF THE INVENTION

Firearm associated electronic devices are provided. In one aspect a firearm associated device has a housing having a holding area and an opening through which a removable component may be positioned in the holding area, a door movable relative to the housing and having a door latch that moves along a path as the door moves and a housing latch movable between a first latch position where the housing latch is not in the path to a second latch position where the housing latch blocks movement of the door latch from a first range of positions where the door prevents the removable component from passing through the opening to a second range of positions where the door does not prevent the removable component from passing through the opening. A housing latch biasing member biases the housing latch into the second latch position. When the door latch is in the first range of positions and the housing latch is in the second latch position the door latch is movable along the path but is blocked by the housing latch from passing to the second range of positions.

DETAILED DESCRIPTION OF THE INVENTION

The drawings provided are for illustration purposes and may not be to scale.

Figure 1:
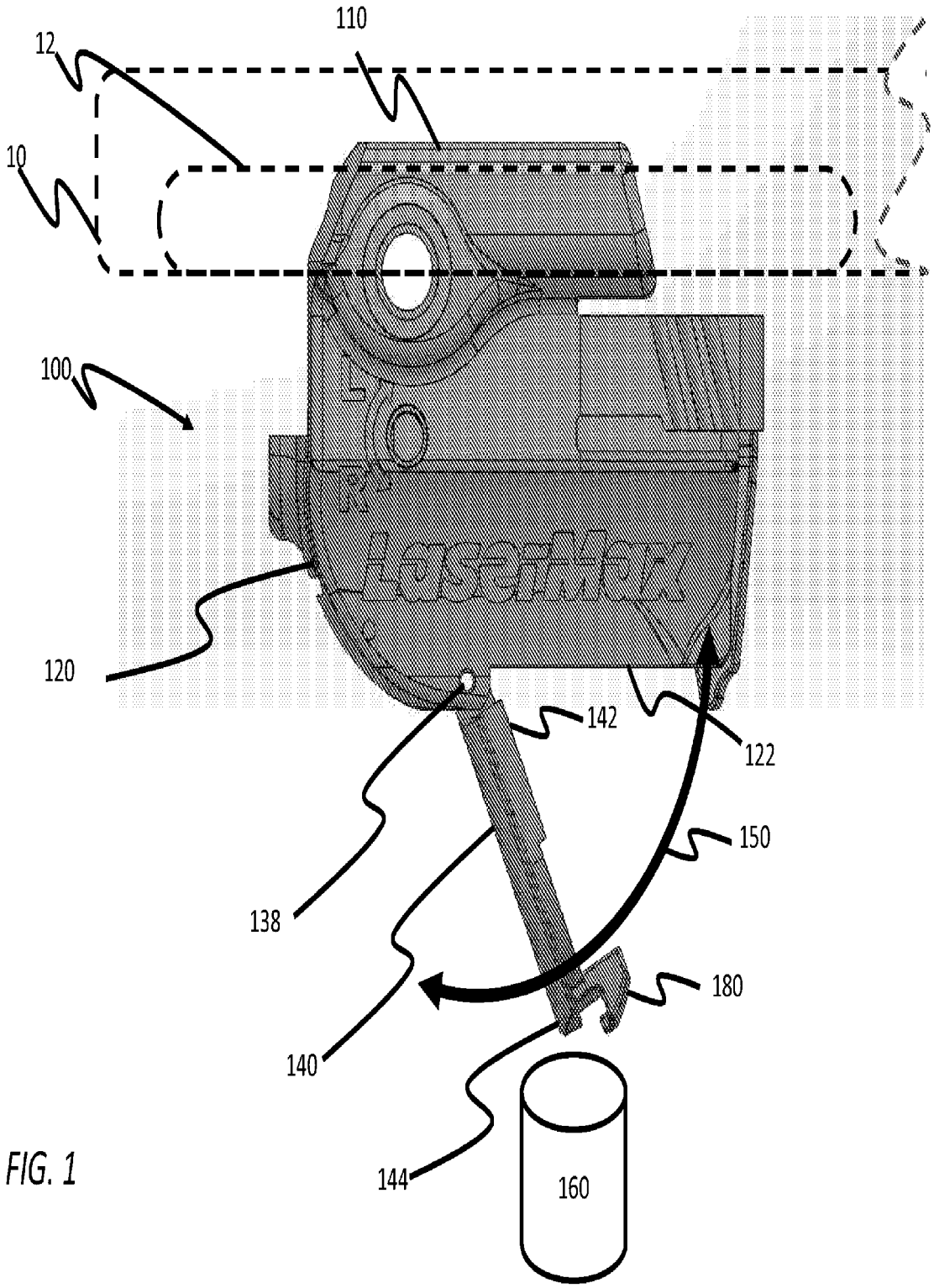
FIG. 1 illustrates a left side elevation view of one embodiment of a firearm associated electronic device having a battery door shown in an open position.

FIG. 1 shows a first embodiment of a firearm associated electronic device 100 for use with a firearm 10. In this embodiment, firearm 10 has a rail 12 such as a Picatinny Rail or Weaver rail or any other known form of firearm mounting surface to which an external device can be joined. Firearm associated electronic device 100 has a rail mount 110 that is co-designed or otherwise adapted or adaptable for use with rail 12 and that allows firearm associated electronic device 100 to be securely mounted to firearm 10. Any other known structure or system that allows firearm associated electronic device 100 to be securely joined, mounted integrated or otherwise physically associated with firearm 10 can also be used. In other embodiments, firearm associated electronic device 100 may be integrally incorporated into components of firearm 10 such as a grip (not shown), handle (not shown), frame (not shown), mounting rail or other component of firearm 10.

Figure 2:
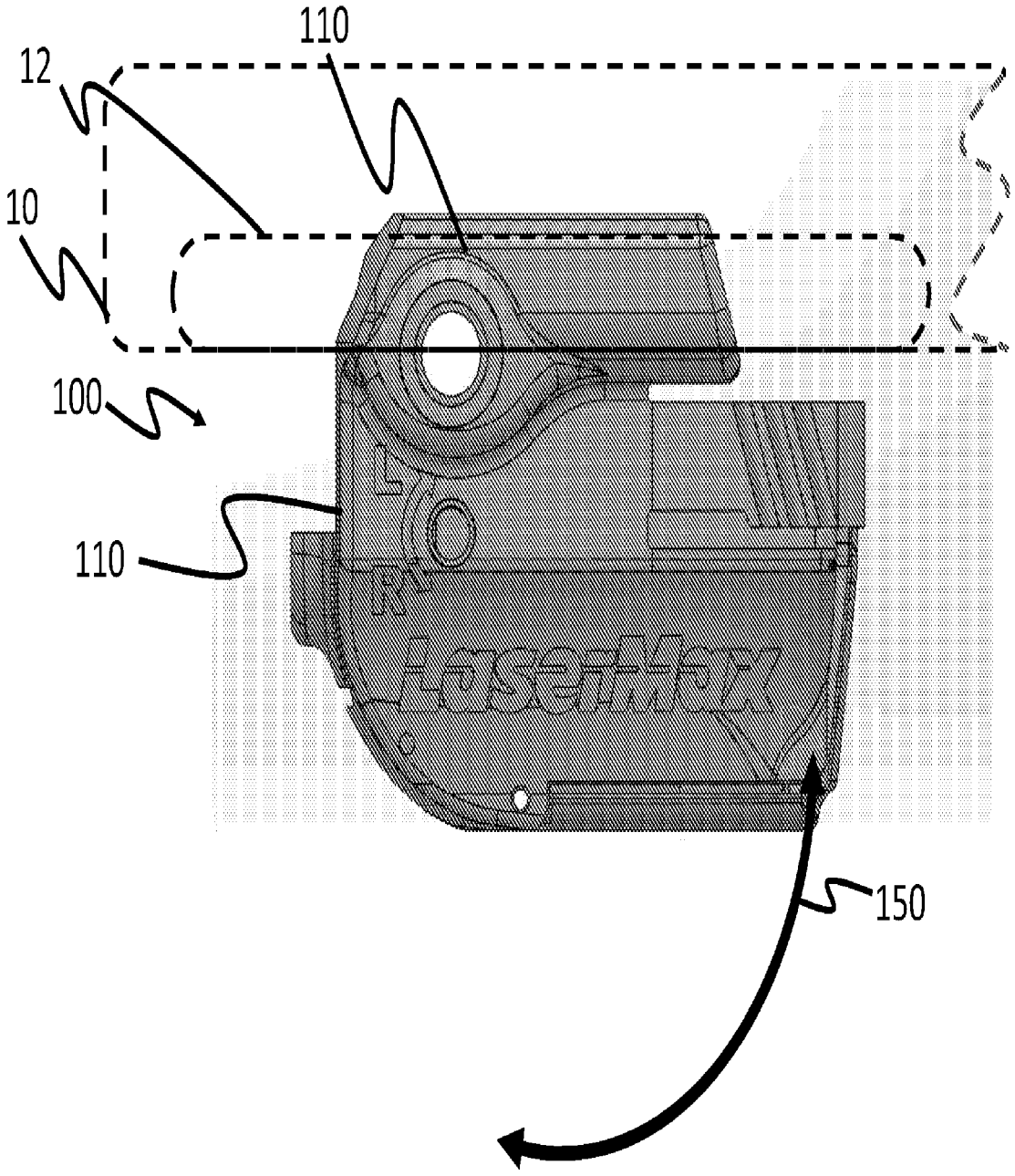
FIG. 2 illustrates a left side elevation view of one embodiment of a firearm associated electronic device for use with a firearm having a battery door shown in a closed position.

As is shown in FIG. 1, firearm associated electronic device 100 has a housing 120 with an opening 122 and a door 140. In the embodiment of FIG. 1, a hinge 138 joins housing 120 to a hinge end 142 of door 140 such that door 140 is pivotally movable along a path 150 through a range of positions that include but are not limited to the position illustrated in FIG. 1, at least one loading position at which door 140 is positioned so that a battery 160 or other removable component can be inserted into or removed from an opening 122 in housing 120 and a latched position as shown in FIG. 2 at which door 140 and housing 120 are latched together to hold battery (not shown in FIG. 2) in housing 120.

Figure 3:
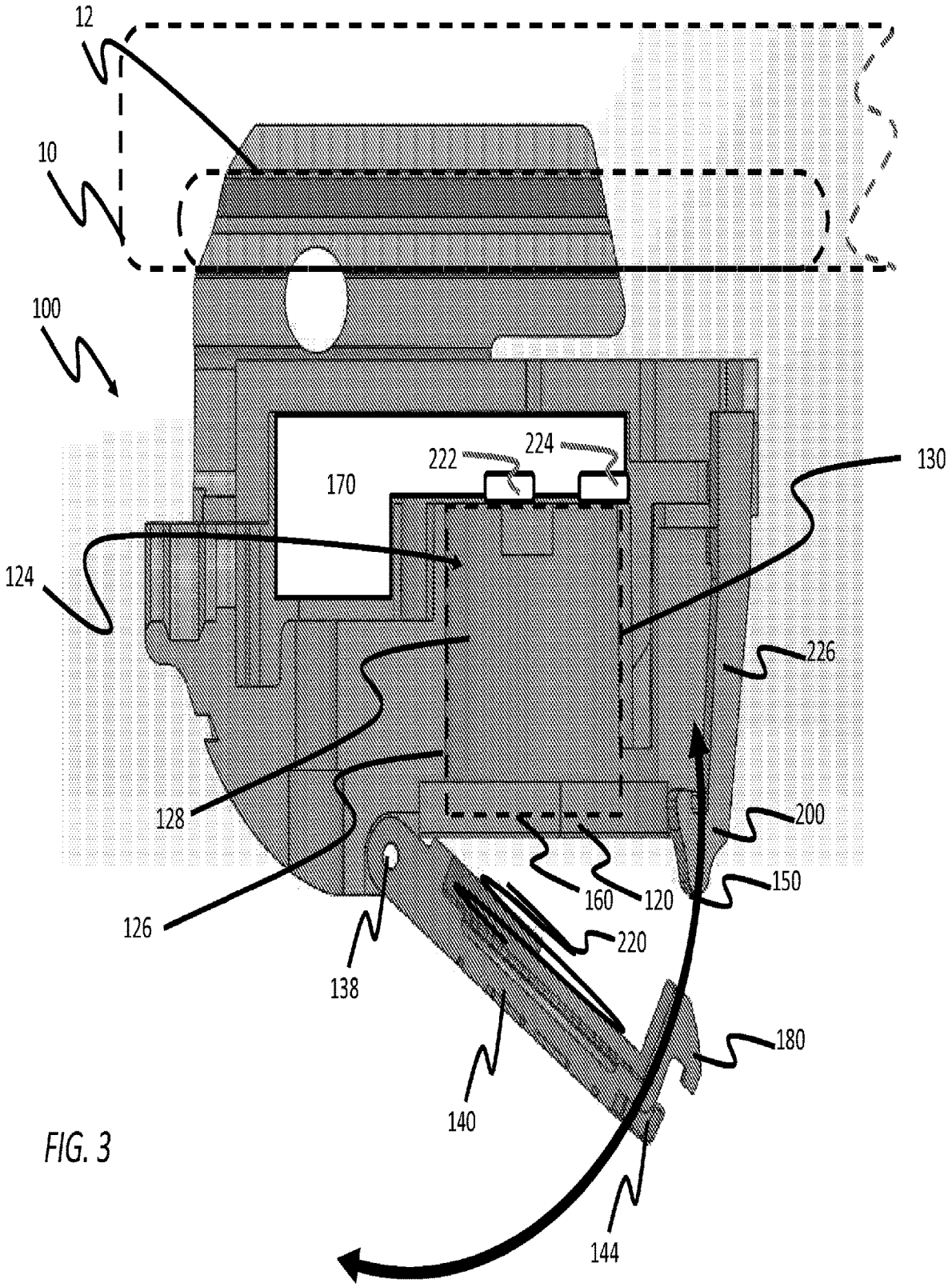
FIG. 3 shows a cross-section view of the firearm mounted firearm associated electronic device of FIGS. 1 and 2 with the battery door in an open position.

FIG. 3 illustrates firearm associated electronic device 100 in cross-section. As is shown in FIG. 3, opening 122 allows battery 160 to pass into and out of a holding area 124 that is sized to receive and to restrict movement of battery 160 when door 140 is in the latched position. Holding area 124 has containment surfaces shown in this view as sidewalls 126, 128 and 130 that cooperate to define boundaries of holding area 124 to allow battery 160 to be held within holding area 124 and to cooperate as necessary with electronics 170 that are located in firearm associated electronic device 100. For the purposes of FIG. 3, electronics 170 are illustrated in block form and the relative size and location of electronics 170 is provided merely for illustration purposes and may in application vary from that illustrated here in any or all of location, shape, orientation and relative size.

Battery 160 is shown in phantom in FIG. 3 and electrical connections between battery 160 and electronics 170 are provided by conductors 222 and 224. In this embodiment, battery 160 is biased into contact with conductors 222 and 224 by a biasing force supplied by a spring 220. Spring 220 is positioned between battery 160 and door 140 and spring 220 is compressed between battery 160 and door 140 as door 140 is closed. Spring 220 resists such compression by providing the bias force that biases battery 160 into contact with electrical conductors 222 and 224 when door 140 is in the closed position.

In the embodiment that is illustrated here spring 220 is shown in the form of a coil spring, however this is not limiting and other springs or materials that can provide a resilient bias can be used for this purpose.

As is can be seen in FIG. 3, a door latch 180 is positioned at a door latch end 144 of door 140 and a housing latch 200 is positioned on housing 120 at a position that is located within path 150 along which door 140 and door latch 180 must to travel into the closed position. One or both of door latch 180 and housing latch 200 are supported in a manner that allows one or both of door latch 180 and housing latch 200 to move in order to allow door 140 to close. In this embodiment, primary deflection comes from a housing resilient member 226 that allows housing latch 200 to be deflected out of path 150 of door latch 180 as door 140 is moved along path 150 in a closing direction. In other embodiments, door 140 can be arranged to support door latch 180 to provide primary deflection. In still other embodiments, hinge 138 can be mounted in a manner that allows resilient deflection of door latch 180. Such techniques may be used in combination.

Figure 4:
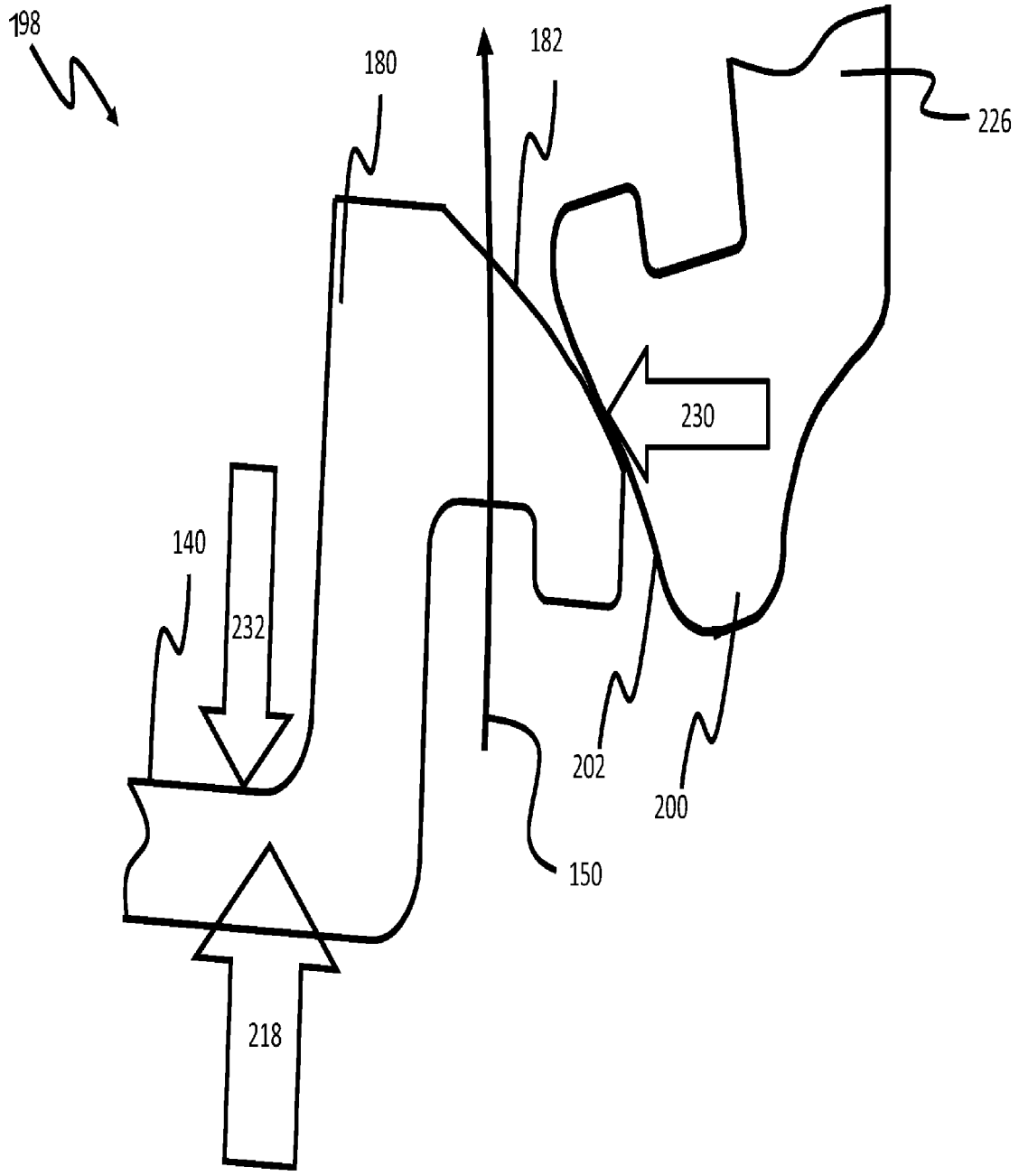
FIG. 4 is a side view of a latching system with a door, door latch, housing latch and housing bias member in a first position during closure.
Figure 5:
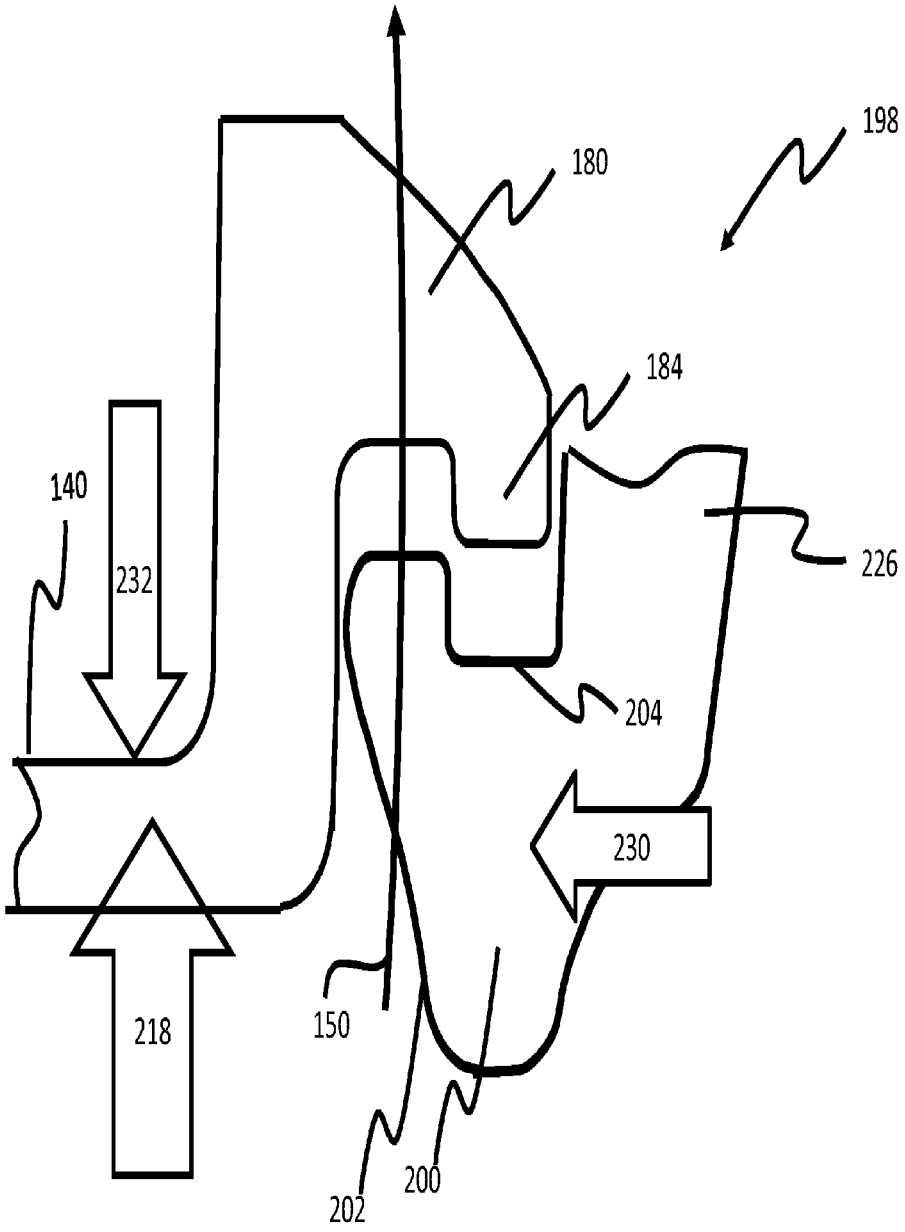
FIG. 5 is a side view of a latching system of FIG. 4 with a door, door latch, housing latch and housing bias member in a second position during closure.
Figure 6:
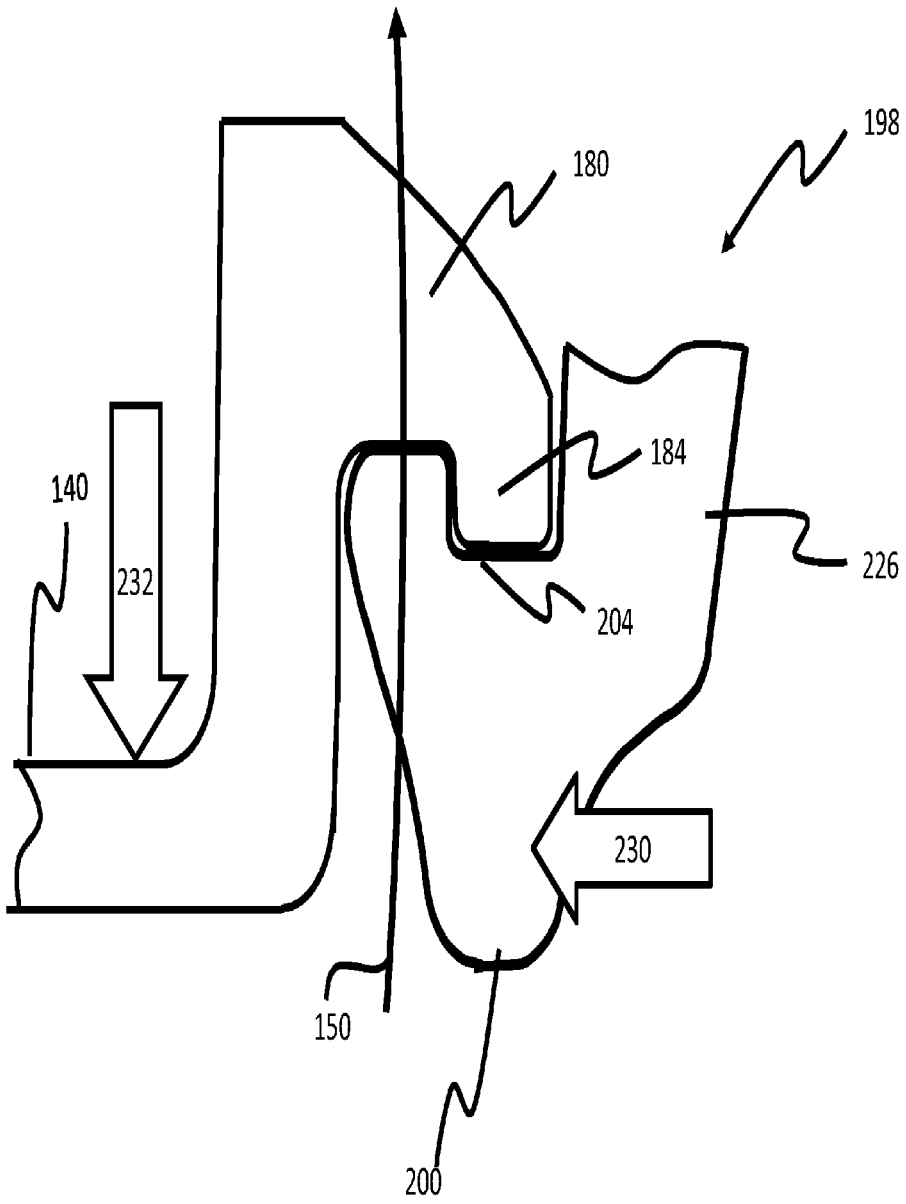
FIG. 6 is a side view of a latching system of FIG. 4 with a door, door latch, housing latch and housing bias member in a latched position.

FIGS. 4-6 illustrate the general operation of one embodiment of latching system 198 useful in firearm associated electronic device 100 using cutaway side views of door 140, door latch 180 and housing latch 200 and housing resilient member 226.

As is shown in FIG. 4, after a user has loaded battery 160 into storage or holding area 124 the user then applies a closure force 218 that urges door 140 in a closure direction along path 150. As door latch 180 is moved along path 150, door latch 180 is moved into contact with housing latch 200. In this embodiment, door latch 180 has at least one contact surface 182 and housing latch 200 has at least one contact surface 202 that are shaped at least in part to facilitate contact with each other such that there is little unnecessary friction or interference that would unduly resist movement of door latch 180 generally along path 150.

When door 140 is in the position illustrated in FIG. 4, housing latch 200 is urged from path 150 against a first bias 230 applied by housing resilient member 226. First bias 230 is overcome by closure force 218 to allow door 140 and door latch 180 to be moved to a position where contact surface 182 is no longer in contact with contact surface 202.

As is shown in FIG. 5, when door 140 and door latch 180 are moved so that contact surface 182 no longer engages contact surface 202 of housing latch 200, there is no further resistance to first biasing force 230 and housing latch 200 is propelled by first biasing force 230 into path 150. This creates a mechanical indication for the user of the firearm associated electronic device 100 that further movement of door 140 and door latch 180 is not necessary. Additional indicators such as mechanical stops can be used to block movement of door 140 and latch 180 when door 140 has been moved sufficiently.

As is described above, as door 140 is moved toward the position that is illustrated in FIG. 5, compression of spring 220 begins. Spring 220 resists compression by exerting force against battery 160 and door 140 and with respect to door 140 this creates a second bias 232 that urges door 140 against closure.

As is shown in FIG. 6, when a user ceases to apply loading force 218, second bias force 232 applied by spring 220 drives a door latch protrusion 184 along path 150 into a housing latch channel 204.

Door latch protrusion 184 and housing latch channel 204, in combination with first bias 230 and second bias 232 provide secure protection against unintended opening of door 140 caused by either high levels of transient acceleration as might be caused by firearm discharge recoil as well as against unintended opening of door 140 as might be caused by inadvertent contact with door 140 or housing latch 200.

Figure 7:
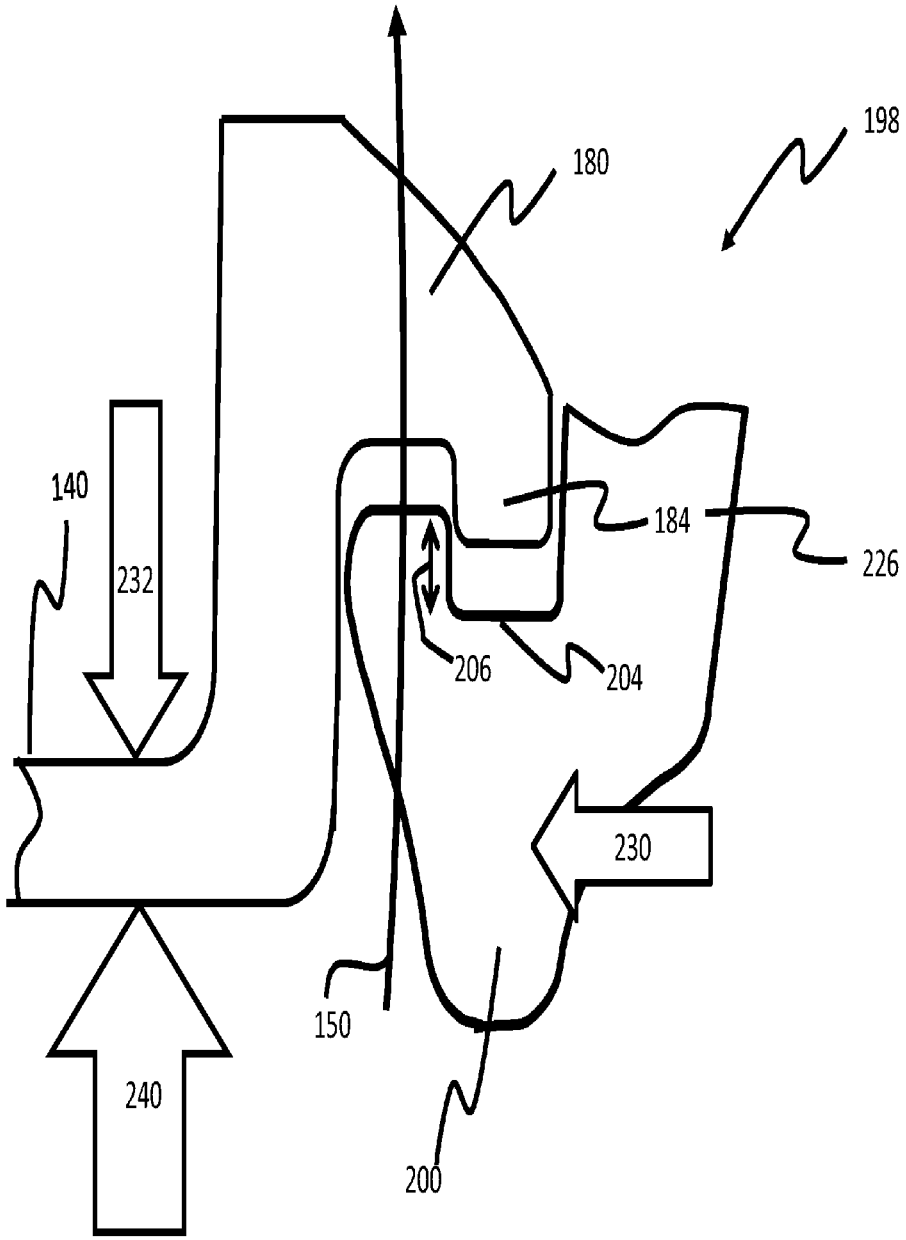
FIG. 7 illustrates the embodiment of FIG. 4 during an example firearm discharge.

For example, as is shown in FIG. 7, in the event of a firearm discharge, firearm associated electronic device 100 may experience a large vertical transient acceleration 240 during discharge or during the damping process. Some of the forces experienced by firearm associated electronic device 100 will be transferred through housing 120 to battery 160. However, to facilitate loading and unloading of battery 160, it is necessary to allow some freedom of movement of battery 160 within storage area 120. This in turn means that in certain respects, battery 160 will react to the transient accelerations in a manner that may be different than that of remaining components of firearm associated electronic device 100. In particular, under certain circumstances, the transient accelerations may be conveyed from the housing 120 to battery 160 by way of hinge 138, door 140, and spring 220. Further, the reaction of battery 160 to the forces applied will also be influenced by the characteristics of spring 220. Accordingly, it is quite possible that battery 160 will have a different reaction profile in response to such accelerations than housing 110, door 140 and other components of firearm associated electronic device 100. For example, battery 160 may, as a result of inertia, remain relatively stationary as housing 120 or door 140 reacts more rapidly to such accelerations.

The differences in the reaction profile may include but are not limited to moving at a different rate in response to the accelerations, moving in different directions in response to the accelerations, different damping frequencies, or different damping phase relationships. For example, it is possible that at some point following firearm discharge housing 120 will be moving in a first direction while battery 160 is moving in a second and opposite direction. It will also be appreciated that door 140 itself is hinged at one end but is freely movable at the other and is subject to similar outcomes, that is door 140 may move at a different rate or frequency than housing 110 during a firearm discharge causing door 140 to possibly move in different directions than housing 110 at times.

Figure 8:
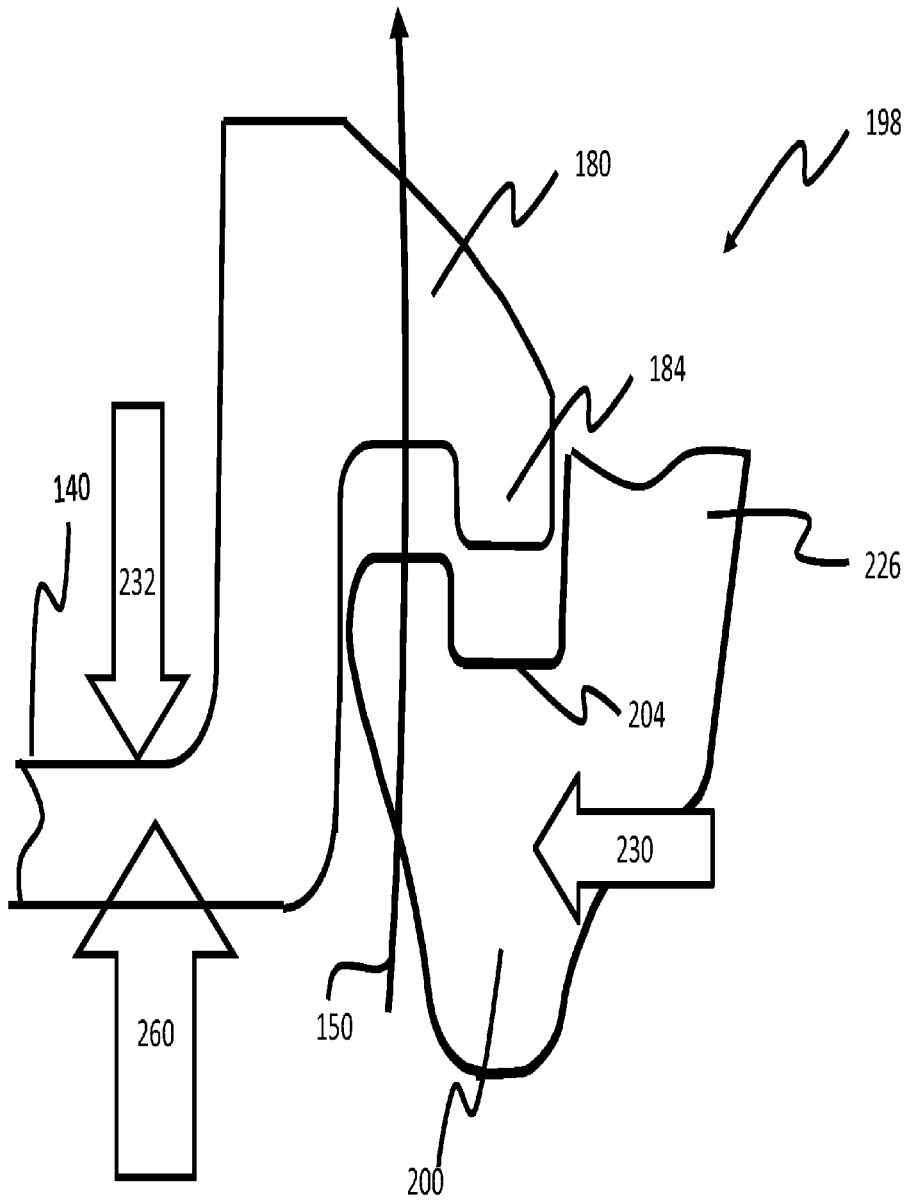
FIG. 8 illustrates the embodiment of FIG. 4 during an example firearm discharge.

It will be appreciated that where such things occur, door 140 and latch 180 may move within a height 206 of channel 204 as illustrated in FIG. 7, without creating a risk of inadvertent release of door 140. Further, even to the extent that door 140 and latch 180 move beyond height 206 there is no opportunity for this to cause an inadvertent release of door 140 as this merely returns door 140 and door latch 180 to a fully separated position as is illustrated in FIG. 8 and even where this happens housing resilient member 226 maintains housing latch 200 in path 150 at a position where second bias 232 will act to advance door 140 and door latch 180 along path 150 to bring door latch protrusion 184 into channel 204 again.

Accordingly, by virtue of this arrangement it becomes possible to provide a latch system that can maintain a latched arrangement between door 140 and housing 120 despite high levels of transient accelerations such as might be experienced by firearm associated electronic device 100 during discharge of firearm 10 or any subsequent recoil—without the use of fasteners.

Further, it will be appreciated that this arrangement also protects against inadvertent opening of door 140 as might be caused by incidental contact between firearm associated electronic device 100 and an external object such as a holster. Here again, it will be appreciated that inadvertent contact between door 140 and such an exterior object can have the effect of pressing door 140 such that door 140 and door latch 180 travel along path 150 in the direction of closing. Such inadvertent contact will either drive door 140 and door latch 180 such that 184 moves by less than distance 206 in which case door 140 will not open for the reasons that are discussed above with reference to FIG. 7. If door 140 moves by more than distance 206 door 140 will not open for the reasons discussed with reference to FIG. 5.

Alternatively, exterior forces caused by incidental contact with firearm associated electronic device 100 may be exerted against housing latch 200 however, so long as door latch protrusion 184 is positioned in channel 204, door latch 180 and door latch protrusion 184 will be capable of cooperating with channel 204 to prevent housing latch 200 from moving in response to such incidental forces.

Figure 9:
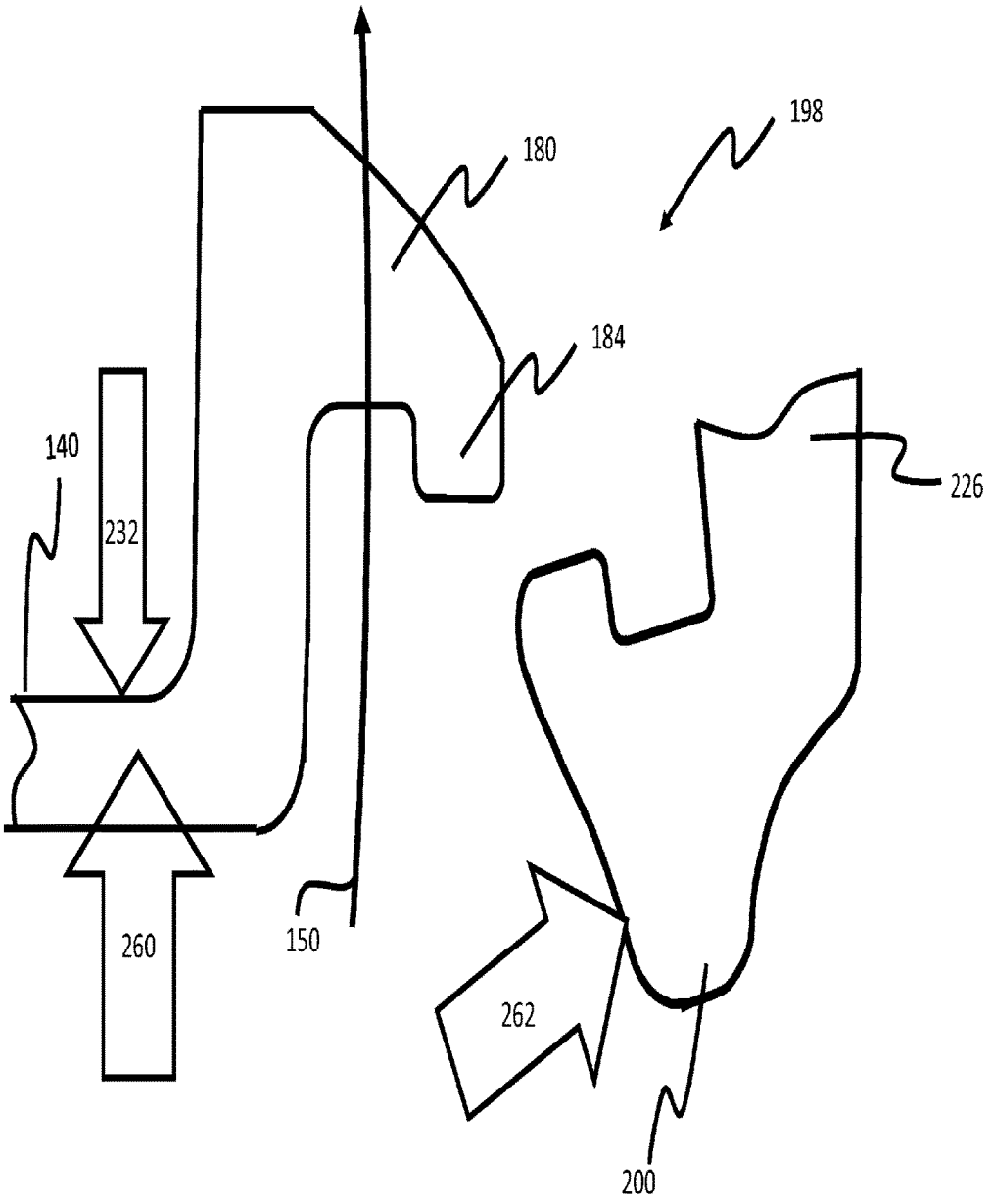
FIG. 9 illustrates forces applied to the embodiment of FIG. 4 to release the door.

Further, as is illustrated in FIG. 9, it will be understood that to open door 140 it is necessary to separate door latch 180 and housing latch 200 with a first force 260 applied along path 150 and this closure force must continue while a second force 262 is applied to housing latch 200 along a direction that is orthogonal to path 150. The closure force 218 must then end while the second force 262 continues to housing latch 200 from path 150 until door latch 180 has passed housing latch 200. Few if any inadvertent or incidental contacts will be capable of achieving such an outcome.

However, such protections against opening of door 140 in response to high transient accelerations and inadvertent contact do not make it more difficult for a user to manually release door 140 so that battery 160 can be replaced. As is shown in FIG. 9, a user of firearm associated electronic device 100 need only apply a first force 260 against door 140 that is sufficient to cause door latch protrusion 184 to move by an amount that is sufficient to separate from channel 204 and to hold door 140 in that position briefly. This can be done for example by one hand of a user while a second hand of a user can apply a second force 262 deflecting housing latch 200 out of path 150. With this done, first force 260 can be released so that second bias force 232 will drive door 140 open. In this way, door 140 of firearm associated electronic device 100 can be quickly and easily opened by a user intending to open door 140 to allow access to battery 160 or any other desired objection in storage area 120.

Figure 10:
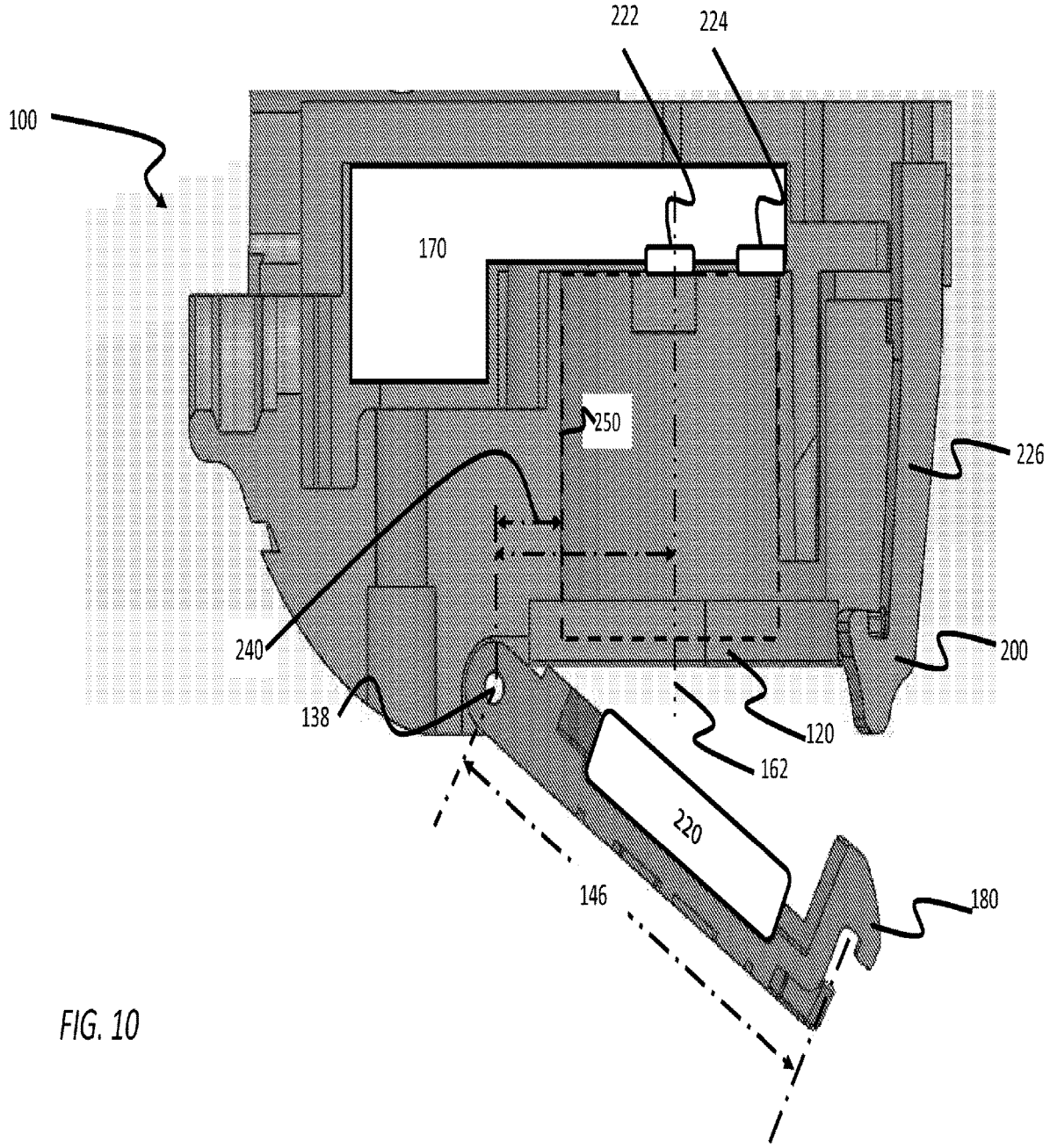
FIG. 10 is an enlarged view of firearm associated electronic device illustrating additional features of embodiments such as the embodiment of FIGS. 1-3.

FIG. 10 is an enlarged view of a portion of a firearm associated electronic device 100 illustrating additional features of embodiments such as the embodiment of FIGS. 1-3. As is shown in FIG. 10, firearm associated electronic device 100 has a housing 110 with hinge 138 located within a distance 240 proximate to an edge 250 of holding area 124. As shown here hinge 138 can be located between about 2 to 25 mm apart from edge 250. In other embodiments, hinge 138 can be located up about 35% of a length 146 of door 140 apart from edge 250.

It will be appreciated that by locating hinge 138 more proximate to edge 250, a distance 164 between the fulcrum provided by hinge 138 and a center of mass 162 of a battery 160 is reduced. Accordingly, hinge 138 is positioned to receive and channel a greater portion of any force applied by battery 160 than hinge 138 would receive in the event that hinge 138 were to be positioned further from edge 250. This reduces the amount of force that must be transmitted by door 140 and that must be managed at door latch 180 and housing latch 200. Additionally, this reduces length 146 of door 140 and allows greater design freedom in the design of door 140, door latch 180 and housing latch 200. Such additional design freedom can be used for example to provide additional functionality or to reduce cost or weight.

Figure 11:
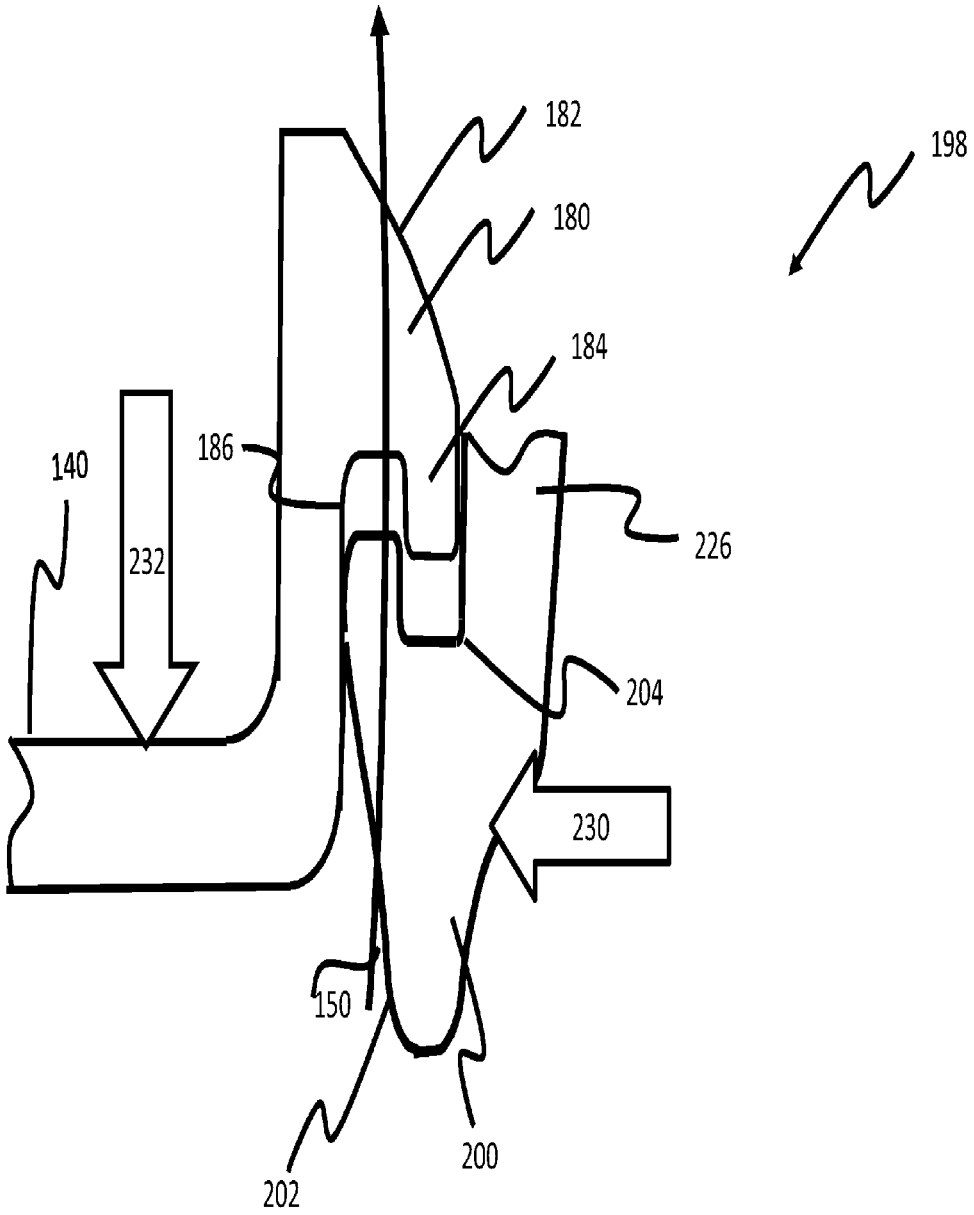
FIG. 11 illustrates another other embodiment of a latching system.

FIG. 11 illustrates another other embodiment of a latching system 198. As is shown in FIG. 11, in this embodiment, housing resilient member 226 positions housing latch 200 in a manner that maintains a bias when housing latch 200 is returned to a location where door latch protrusion 184 can be seated in housing latch channel 204. In the embodiment of FIG. 11, door latch 180 has a latching position contact surface 186. In this embodiment, first bias 230 drives housing contact surface 202 into contact with latching position contact surface 186 after contact between contact surface 202 and contact surface 182 ends. In the embodiment of FIG. 11, door latch 180 and housing latch 200 can be defined so that when latching position contact surface 186 is in contact with contact surface 200 door latch protrusion 184 will be aligned with housing latch channel 204. It will be appreciated that this allows alignment of door latch protrusion 184 and housing latch channel 204 with greater precision. This greater precision can be used for example to allow designers to reduce the extent of any tolerances allotted between door latch protrusion 184 and housing latch channel 204. This, in turn, can increase design flexibility such as by allowing door latch 180 and housing latch 200 to be made smaller as is conceptually illustrated here. Alternatively, the improved precision can be used to allow door latch 180 and housing latch 200 to be made lighter such as by having smaller volume. Alternatively, this can increase design flexibility such as by allowing door latch 180 and housing latch 200 to be made more robust such as by making door latch protrusion 184 and housing latch channel 204 larger.

The described embodiments of firearm associated electronic device 100 provide a rugged and reliable containment system for battery 160 or other separable component, that is resistant to release caused by high levels of transient acceleration that is also resistant to release caused by inadvertent contact and that is also easily accessible when wanted.

The invention has been described in detail with particular reference to certain preferred embodiments thereof, but it will be understood that variations and modifications can be effected within the spirit and scope of the invention.

What is claimed is:

1. A firearm associated electronic device comprising:

a housing having a holding area sized to receive a removable component;

a door movable relative to the housing between an open position that permits access to the holding area and a closed position that restricts access to the holding area, the door including a door latch having a protrusion that moves along a path;

a housing latch movable between a first latch position and a second latch position, the housing latch including a channel that extends at least partially along the path and sized to receive the protrusion, wherein in the first latch position, the housing latch is located outside of the path and the door is permitted to transition from the closed position to the open position, and in the second latch position:

the door latch has a first range of positions where the protrusion is located within the channel and the door is restricted from transitioning from the closed position to the open position; and the door latch has a second range of positions where the protrusion is located outside the channel, in the second range of positions access to the holding area is restricted due to the housing latch being within the path, but while the door latch is in the second range of positions, the door is permitted to transition from the closed position to the open position via a biasing force applied to the housing latch; and a housing latch biasing member biasing the housing latch into the second latch position.

2. The device of claim 1, further comprising a door biasing member biasing the door latch toward the housing latch.

3. The device of claim 2, wherein the removable component has at least one electrical connection and the door biasing member further biases the removable component into contact with the at least one electrical connection.

4. The device of claim 2, wherein the removable component has a mass and the door biasing member is a resilient member positioned between the removable component and the door so that the resilient member receives at least a portion of any inertial forces associated with removable object as the removable component responds to accelerations experienced by the firearm associated electronic device.

5. The device of claim 1, wherein the door is pivotally coupled to the housing at a hinge end and the door latch is positioned at a door latch end apart from the hinge end.

6. The device of claim 5, wherein the pivotal coupling between the door and the housing is proximate to the holding area to reduce the distance between a fulcrum provided by the pivotal connection and a center of mass of the removable component to reduce the extent of leveraged force applied by the removable component against the door and latch during a discharge of the firearm.

7. The device of claim 1, wherein the door has a latch position contact surface against which the housing latch biasing member biases a contact surface of the housing latch when the door latch is in the first range of positions, and wherein the channel is positioned relative to contact surface and the protrusion is positioned relative the latch position contact surface to align the protrusion with the channel when the contact surface is positioned against the latch position contact surface.

8. The device of claim 2, wherein the door biasing member and the housing latch biasing member bias the door latch and the housing latch so that the door latch protrusion fits back into the housing latch channel even when the door latch moves in response to accelerations in a manner that separates the door latch protrusion from the housing latch channel.

9. The device of claim 2, wherein movement of the door latch relative to the housing latch is resisted by action of the door biasing member.

10. The device of claim 1, wherein the door has a latch position contact surface against which the housing latch biasing member biases the housing latch when the door latch is in the first range of positions.

11. The device of claim 1, wherein the door has a latch position contact surface against which the housing latch biasing member biases the housing latch when the door latch is in the second range of positions.

12. The device of claim 1, wherein the door latch has a contact surface shaped to engage a contact surface of the housing latch so that when the door is urged from the first range of positions toward the second range of positions, the contact surface of the door latch engages with the contact surface of the housing latch to urge the housing latch out of the path.

13. A firearm associated electronic device comprising:

a housing having a holding area and an opening through which a removable component may be positioned in the holding area;

a door pivotally connected at a hinge end to the housing relative to the housing and having a door latch end with a door latch that moves along a first path as the door moves;

a door biasing member that urges the door latch away from the holding area;

a housing latch movable between a first housing latch position and a second housing latch position, wherein in the first housing latch position the housing latch is located outside the first path, and wherein in the second housing latch position the housing latch blocks movement of the door latch from a first range of positions where the door prevents the removable component from passing through the opening to a second range of positions where the door does not prevent the removable component from passing through the opening; and a housing latch biasing member biasing the housing latch into the second latch position;

wherein the door latch has a protrusion extending along the first path that fits within a housing latch channel of the housing latch, the housing latch channel having a height extending generally along the first path and the protrusion of the door latch extending along the first path and sized to fit inside the housing latch channel to allow a range of movement of the protrusion relative to the channel along the first path with at least a portion of the protrusion of the door latch remaining in the housing latch channel in the first range of position, so as to not provide access to the holding area, to prevent separation of the door latch from the housing latch along a second path that is not parallel to the first path during accelerations of the firearm associated electronic device.

14. The firearm associated electronic device of claim 13, wherein the door has a latch position contact surface against which the housing latch biasing member biases a contact surface of the housing latch when the door latch is in the first range of positions, and wherein the channel is positioned relative to contact surface and the protrusion is positioned relative the latch position contact surface to align the protrusion with the channel when the contact surface is positioned against the latch position contact surface.

15. A device configured to mount to a firearm, the device comprising:

a housing including:

a cavity; and a first latch moveable between a first position and a second position, the first latch having a channel; and a cover pivotably coupled to the housing, the cover being moveable between a closed state in which access to the cavity is restricted and an open state in which access to the cavity is permitted, the cover including a second latch that engages with the first latch, the second latch having a protrusion that at least partially resides within the channel when the first latch and the second latch engage, and wherein:

in the closed state, the cover is permitted to extend in a first direction to dispose the protrusion outside of the channel, but while the cover is extended in the first direction, the cover is restricted from transitioning to the open state, so as to not provide access to the cavity, due to the first latch being located in the first position that is within a travel path of the second latch; and biasing the first latch in a second direction to the second position while the cover is extended in the first direction causes the first latch to be disposed outside of the travel path and permits the cover to transition to the open state.

16. The device of claim 15, wherein the first direction is substantially orthogonal to the second direction.

17. The device of claim 15, wherein transitioning the cover from the open state to the closed state deflects the first latch in the second direction to the second position.

18. The device of claim 17, wherein:

the second latch deflects the first latch in the second direction to the second position; and after the second latch deflects the first latch in the second direction to the second position, a biasing force biases the first latch biases back to the first position, wherein upon returning to the first position, the first latch and the second latch engage.

19. The device of claim 15, further comprising a biasing member that provides force in a third direction that is opposite the first direction to prevent disengagement of the first latch and the second latch.

20. The device of claim 15, wherein when the protrusion at least partially resides within the channel, the first latch is prevented from moving from the first position to the second position.

* * * * *